US006557474B1

(12) United States Patent
Morte et al.

(10) Patent No.: US 6,557,474 B1
(45) Date of Patent: May 6, 2003

(54) INITIATOR HEADER SUBASSEMBLY FOR INFLATION DEVICES

(75) Inventors: Caesar B. Morte, Lakewood, NJ (US); Richard L. Ferraid, Brielle, NJ (US)

(73) Assignee: Glasseal Products, Lakewood, NJ (US)

( * ) Notice: Subject to any disclaimer, the term of this patent is extended or adjusted under 35 U.S.C. 154(b) by 0 days.

(21) Appl. No.: 09/650,530

(22) Filed: Aug. 30, 2000

(51) Int. Cl.[7] ..... F42B 3/18

(52) U.S. Cl. ..... 102/202.1; 102/202.7; 102/202.9; 102/202.14; 361/247

(58) Field of Search ..... 102/202.1–202.9, 102/202.11, 202.13, 202.14; 361/247, 248

(56) References Cited

U.S. PATENT DOCUMENTS

| | | | | | |
|---|---|---|---|---|---|
| 3,683,811 | A | * | 8/1972 | Driscoll | 102/202.7 |
| 3,723,205 | A | | 3/1973 | Scheffee | 149/19 |
| 4,054,095 | A | * | 10/1977 | Morrow | 102/202.5 |
| 4,422,381 | A | * | 12/1983 | Barrett | 102/202.2 |
| 4,981,534 | A | | 1/1991 | Scheffe | 149/85 |
| 5,088,413 | A | * | 2/1992 | Huber et al. | 102/202.1 |
| 5,230,287 | A | | 7/1993 | Arrell, Jr. et al. | 102/202 |
| 5,243,492 | A | * | 9/1993 | Marquit et al. | 102/202.9 |
| 5,345,872 | A | * | 9/1994 | Takahashi et al. | 102/202.2 |
| 5,431,101 | A | | 7/1995 | Arrell, Jr. et al. | 102/205 |
| 5,793,476 | A | | 8/1998 | Laakmann et al. | 356/28 |
| 5,798,476 | A | | 8/1998 | Bailey | 102/202.7 |
| 5,922,468 | A | * | 7/1999 | Huesmann et al. | 428/422 |
| 6,351,355 | B1 | * | 3/2002 | Fogle, Jr. | 102/202.2 |

* cited by examiner

*Primary Examiner*—Harold J. Tudor
(74) *Attorney, Agent, or Firm*—Lerner, David, Littenberg, Krumholz & Mentlik, LLP

(57) ABSTRACT

An initiator header subassembly for an inflation device, such as "air bag" safety system, includes an electrically conductive grounding tab having an outer perimeter, and a mass of an insulating material secured atop the grounding tab, the mass of an insulating material having a top surface, a bottom surface and a sidewall extending between the top and bottom surfaces. The initiator header subassembly includes two electrically conductive pins extending completely through the grounding tab and the mass of an insulating material. A first one of the electrically conductive pins is electrically interconnected with the grounding tab and a second one of the electrically conductive pins is electrically isolated from the grounding tab. The sidewall of the mass of an insulating material is in substantial alignment with the outer perimeter of the grounding tab.

33 Claims, 12 Drawing Sheets

INITIATOR HEADER SUBASSEMBLY FOR INFLATION DEVICES

BACKGROUND OF THE INVENTION

The present invention relates to initiating devices for combustible materials and, more particularly, to initiator headers used to initiate the detonation of propellants, pyrotechnics, explosive materials and the like.

A wide variety of devices are used to detonate or ignite explosives and pyrotechnic materials.

One type of device commonly referred to as an initiator header, generally includes one or more conductive pins, surrounded by an insulating layer. The one or more conductive pins generally terminate at a thin bridge wire disposed along a top surface of the insulating layer. When an electric current is passed through one of the conductive pins, the current passes through the bridge wire which rapidly heats due to its electrical resistance. The heat generated by the bridge wire ignites a propellant which, in turn, ignites a gas-generating composition. Combustion of the gas-generating composition results in the production of a gas which may be used to perform a task such as inflating an automobile air bag or ejecting a pilot from a combat aircraft.

For many years, automobile manufacturers have used initiator headers as part of automobile air bag safety systems, such as those described in U.S. Pat. Nos. 3,723,205 and 4,981,534. As is well known to those skilled in the art, air bag systems are designed to rapidly inflate sealed bags with an inflatable gas when a sensor detects an automobile collision. Due to the nature of their use, air bag systems may never be used or may remain idle for many years. Despite these extended periods of inactivity, air bag systems must operate properly when they are needed. Of equal importance is the fact that air bag systems must not inadvertently deploy, a highly undesirable event that could result in death or severe injury.

There have been many efforts directed to producing low cost and easily assembled initiator headers. For example, U.S. Pat. Nos. 5,230,287 and 5,431,101 to Arrell, Jr. et al. disclose an electronically-activated initiator formed by welding a hollow cap containing an explosive material to an initiator header. The outer diameter of the initiator header slightly exceeds the inner diameter of the hollow cap so that, as the two are joined together, the header and cap form a reliable, weldable joint.

U.S. Pat. No. 5,243,492 to Marquit et al. discloses a process for making an initiator device having a centrally located conductive pin.. The pin can be electrically connected to an outer portion of the device via a bridge wire, thereby forming a device that is particularly useful for igniting a gas-generating composition in an air bag safety system.

U.S. Pat. No. 5,793,476 to Bailey discloses an electronically activated initiator header for an air bag inflator. The initiator header is ignitable by thermal energy from a resistive element formed on a semiconductor substrate. The semiconductor substrate is secured to the initiator header by a glass-to-metal seal.

In spite of the above-mentioned improvements in initiator devices, there remains a need for a reliable initiator header which is inexpensive, has fewer parts, and is easier to assemble.

SUMMARY OF THE INVENTION

In accordance with certain preferred embodiments of the present invention, an initiator header subassembly includes an electrically conductive grounding tab having an outer perimeter. The grounding tab is preferably made of a conductive material, such as metal. In highly preferred embodiments, the grounding tab is made of an alloyed metal, such as the alloyed metal commonly sold under the trademark KOVAR®. The grounding tab may comprise a substantially flat plate having a top surface, a bottom surface and two holes extending between the top and bottom surfaces. In certain preferred embodiments, the grounding tabs are produced by first punching or stamping a plurality of coin-like grounding tabs from a sheet of conductive material. The conductive material may include a metal such as KOVAR® alloyed metal. Each grounding tab is then further processed to form the two holes extending between the top and bottom surfaces thereof. In certain preferred embodiments, a first one of the two grounding tab holes has a first diameter and a second one of the two grounding tab holes has a second diameter that is greater than the diameter of the first grounding tab. The entire process of producing the grounding tabs and then producing the holes extending therethrough may be done using a machine tool which punches or stamps the structure.

The initiator header subassembly of the present invention also desirably includes a mass of an insulating material that is secured atop the top surface of the grounding tab. The mass of an insulating material preferably has a top surface, a bottom surface and a sidewall extending between the top and bottom surfaces. After the mass of an insulating material has been secured to the grounding tab, the sidewall of the insulating mass is preferably in substantial alignment with the outer perimeter of the grounding tab. In other embodiments, the sidewall of the insulating mass defines the outer perimeter of the initiator head subassembly.

The mass of an insulating material may be an insulating disc preform having two longitudinal openings extending from the top surface to the bottom surface of the insulating disc. The two longitudinal openings desirably have a substantially similar diameter. As used herein, the term "insulating disc preform" means that a plurality of insulating discs may be mass-produced and stored for later use during final assembly of initiator headers. As such, each of the insulating disc preforms may be substantially similar in shape, composition and appearance so that the insulating discs are interchangeable with one another. In certain preferred embodiments, the insulating disc is an all-glass insulating disc having a relatively high hardness rating capable of withstanding up to 20,000 psi or more. The insulating disc may be made of such glasses as borosilicate glass.

The initiator header subassembly may also include a pair of electrically conductive pins extending completely through the grounding tab and the insulating disc. The conductive pins preferably pass through the respective first and second holes of the grounding tab. In certain embodiments, a first one of the electrically conductive pins is attached to and electrically interconnected with the grounding tab and a second one of the electrically conductive pins is electrically isolated from grounding tab. The electrically conductive pins may be made by cutting sections of wire, having a predetermined length from a spool of metal wire, such as KOVAR® alloyed metal. After a plurality of such predetermined lengths have been cut from the spool, the pins are placed in a tumbler which rounds off the ends of the pins. The pins may also be machine tooled to round off the ends.

A fixture may be used for assembling one or more of the above-described initiator header subassemblies. On the other hand, the outer diameter of the electrically conductive pins closely matches the inner diameter of the two longitudinal openings extending through the insulating disc. The fixture preferably holds all of the components of the initiator assembly in proper orientation relative to one another during the assembly process. This may be accomplished by matching the diameter of the outer surface of the first pin with the diameter of the first hole through the grounding tab, while the second grounding tab hole has a greater diameter than the first hole. In certain preferred embodiments, the fixture includes a lower member having one or more cavities for receiving the various components of the initiator header subassembly and an upper member or cap that is securable atop the lower fixture member. In one particularly preferred assembly method, the electrically conductive pins are cut to predetermined lengths as described above. The pins are then exposed to a chemical etchant that roughens or pits the outer surface of the pins. Although the present invention is not limited by any particular theory of operation, it is believed that pitting the outer surface of the pins will increase the exposed surface area of the pins, which will enhance the strength of the glass-to-metal seal between the conductive pins and the insulating disc. The pins are then subjected to an oxidizing process which forms a thin oxide layer atop the pitted outer surface of the pins. The pins are then positioned within the cavity of the lower fixture member. The cavity preferably holds the pins in a substantially parallel orientation relative to one another. In one preferred embodiment, the cavity of the fixture holds the pins in a substantially vertical orientation relative to a table top supporting the fixture.

A grounding tab is then positioned over the upper ends of the pins and moved in a downward direction so that the pins pass through the holes in the grounding tab. The cavity of the fixture preferably includes a shelf which holds the grounding tab at an elevation located between the upper and the lower ends of the two conductive pins. As mentioned above, the diameter of the first grounding tab hole substantially matches the diameter of the outer surface of the pin so that the pin and first grounding tab hole are in close contact with one another. The diameter of the second grounding tab hole is preferably larger than the diameter of the outer surface of the second conductive pin passing therethrough so that the second grounding tab remains electrically isolated from the second conductive pin. A metallic washer or ring may be placed around the first conductive pin and held by the fixture adjacent an upper or lower surface of the grounding tab. The metallic washer or ring may include a copper-silver alloy which creates an intermetallic bond or braze joint between the first conductive pin and the first hole extending through the grounding tab. Before the grounding tab is placed in the cavity of the lower member of the fixture, the grounding tab may be exposed to a chemical etchant which roughens or pits the outer surface of the grounding tab. The grounding tab is then subjected to an oxidizing process which forms an oxide layer over the pitted outer surface of the grounding tab.

An insulating disc may then be placed in the cavity of the fixture and atop the grounding tab so that the longitudinal openings of the insulating disc are in substantial alignment with the first and second holes of the grounding tab and so that the conductive pins pass through the two longitudinal openings. The upper member of the fixture is then placed atop the lower member of the fixture and the fixture is placed in a furnace which heats the assembly to approximately 1700–1900° F. When the components of the initiator header subassembly are heated, the all-glass insulating disc transforms from a solid state into a molten state so as to facilitate the formation of a glass-to-metal seal with the outer surface of the conductive pins and the top surface of the grounding tab. The fixture may then be removed from the furnace and placed on a cooling rack.

In certain preferred embodiments, the grounding tab and the electrically conductive pins have a substantially similar coefficient of thermal expansion. In yet other preferred embodiments, the grounding tab, the insulating disc and the electrically conductive pins all have a substantially similar coefficient of thermal expansion.

After assembly of the initiator header subassembly, the upper ends of the two electrically conductive pins are preferably accessible at the top surface of the insulating disc. An electrically conductive element, such as a bridge wire or a semiconductor bridge, may then be attached to the upper ends of the two electrically conductive pins exposed at the top surface of the insulating disc. In other embodiments, the bridge wire or semiconductor bridge may not be placed directly on the top surface of the insulating disc, but may be spaced from the top surface so as to span a gap between the two electrically conductive pins.

In the final assembly, the first electrically conductive pin is attached to and electrically interconnected with the first grounding tab hole. The second conductive pin is preferably spaced from the inner diameter of the second grounding tab hole so that the second conductive pin is electrically isolated from the grounding tab. As such, the pair of electrically conductive pins pass through the aligned longitudinal openings of the insulating disc and the two holes extending through the grounding tab.

In certain preferred embodiments, the grounding tab may include a sealing flange that preferably extends or projects from the bottom surface of the grounding tab. The sealing flange extends in a direction that is substantially perpendicular to the top surface of the grounding tab. The sealing flange preferably has an outer perimeter that substantially matches the outer perimeter of the grounding tab. A hollow cap filled with an explosive material may be secured atop the initiator header subassembly. The hollow cap preferably has a closed end and an open end. To assemble the initiator header with the cap, the upper ends of the conductive pins are first inserted into the open end of the hollow cap. The inner diameter of the hollow cap preferably has a diameter that closely matches the outer diameter of the initiator header, the outer perimeter of the grounding tab and/or the outer perimeter of the sealing flange.

In other preferred embodiments, an initiator header subassembly includes an electrically conductive grounding tab having a top surface, a bottom surface and two holes extending between the top and bottom surfaces, the grounding tab having an outer perimeter. The subassembly also includes an insulating disc secured atop the first surface of the grounding tab. The insulating disc desirably has a top surface, a bottom surface, an outer peripheral surface extending between the top and bottom surfaces of the insulating disc, and two longitudinal openings extending between the top and bottom surfaces, the longitudinal openings being in substantial alignment with the two holes extending through the grounding tab. Two electrically conductive pins preferably extend completely through the holes in the grounding tab and the longitudinal openings in the insulating disc. A first one of the electrically conductive pins is electrically interconnected with the grounding tab and a second one of the electrically conductive pins is electrically isolated from the grounding tab. The peripheral surface of the insulating disc is in substantial alignment with the outer perimeter of the grounding tab. In other embodiments, the peripheral surface of the insulating disc defines the outer perimeter of the initiator header subassembly. In the above-described assembly, the grounding tab, the insulating disc and the electrically conductive pins preferably have a substantially similar coefficient of thermal expansion. The grounding tab, electrically insulating disc and electrically conductive pins are desirable secured together using one or more glass-to-metal seals. The insulating disc preferably is an all-glass disc, such as borosilicate glass.

In still another preferred embodiment of the present invention, an initiator header subassembly includes a conductive grounding tab having an outer perimeter, and an insulating disc secured atop the conductive grounding tab. The insulating disc desirably has an outer peripheral surface that is in substantial alignment with the outer perimeter of the grounding tab. The initiator header subassembly also preferably includes a pair of electrically conductive pins extending completely through the conductive grounding tab and the insulating disc. A first one of the pins is electrically interconnected with the grounding tab and a second one of the pins is electrically isolated from the grounding tab. The pair of electrically conductive pins are preferably substantially parallel with one another. The grounding tab may be made of a conductive material, such as KOVAR® alloyed metal. The insulating disc may be made of glass capable of withstanding up to 20,000 psi or more. In certain preferred embodiments, the insulating disc is made of borosilicate glass.

These and other preferred embodiments of the present invention will be described below in more detail.

DETAILED DESCRIPTION

Figure 1:
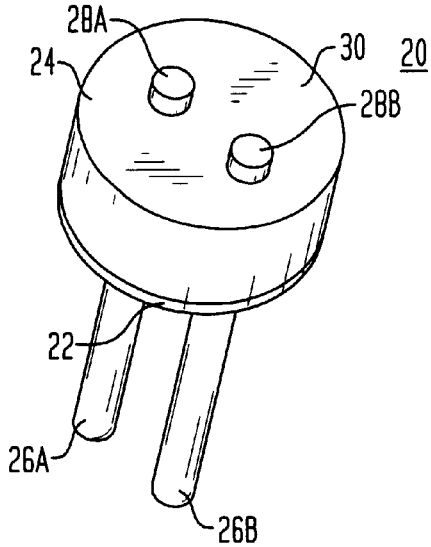
FIG. 1 shows a perspective view of an initiator header subassembly, in accordance with certain preferred embodiments of the present invention.

FIG. 1 shows an initiator header subassembly 20, in accordance with certain preferred embodiments of the present invention. The initiator header subassembly 20 includes a grounding tab 22, preferably made of an electrically conductive material such as metal. In certain preferred embodiments, the metal is alloyed metal such as the alloyed metal sold under the trademark KOVAR®. The initiator header subassembly also preferably includes a mass of an insulating material 24, such as an all-glass insulating mass, and a pair of electrically conductive pins 26A, 26B extending completely through the grounding tab 22 and the insulating mass 24. Upper ends 28A, 28B of the electrically conductive pins 26A, 26B are preferably accessible at a top surface 30 of the insulating mass 24. In certain preferred embodiments, the upper ends 28A, 28B of the conductive pins 26A, 26B may project above the top surface 30 of the insulating mass 24.

Figure 2:
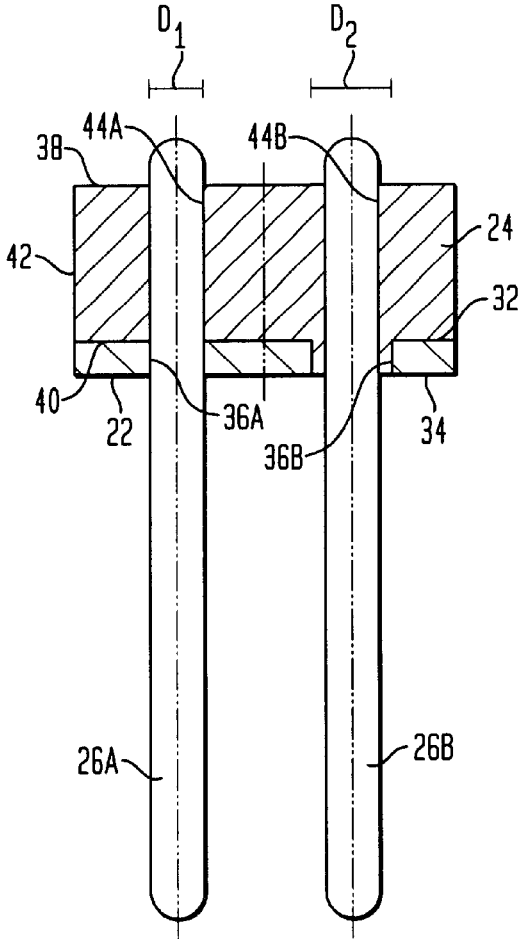
FIG. 2 shows a cross-sectional view of the initiator header subassembly of FIG. 1, including a grounding tab, a mass of an insulating material and a pair of electrically conductive pins extending through the grounding tab and the mass of an insulating material.

Referring to FIG. 2, grounding tab 22 is preferably a substantially flat piece having a top surface 32 and a bottom surface 34. Grounding tab preferably has two or more holes 36A, 36B extending from the top surface 32 to the bottom surface 34 thereof. In FIG. 2, a first grounding tab hole 36A has a first diameter designated $D_1$. Grounding tab 22 also has a second hole 36B extending therethrough with a second diameter designated $D_2$. The diameter $D_2$ of the second grounding tab 36B hole is larger than the diameter $D_1$ of the first grounding tab hole 36A. The initiator header subassembly also includes the mass of an insulating material 24 secured atop the first surface 32 of grounding tab 22. The insulating mass 24 preferably has a top surface 38, a bottom surface 40 and at least one sidewall 42 extending between the top and bottom surfaces 38, 40. The insulating mass 24 also preferably has a pair of longitudinal openings 44A, 44B extending between the top and bottom surfaces 38, 40 thereof. The longitudinal openings are sized and shaped to receive the pair of electrically conductive pins 26A, 26B. In certain preferred embodiments, the diameters $D_3$, $D_4$ of the respective longitudinal openings 44A, 443 closely match the outer perimeters of the conductive pins 26A, 26B.

The electrically conductive pins 26A, 26B may be produced by first providing a spool of a metallic wire, such as a spool of KOVAR® alloyed metal wire. The KOVAR® alloyed metalwire is preferably cut at predetermined lengths to produce a plurality of electrically conductive pins having a predetermined length. In certain preferred embodiments, the wire is cut to provide a plurality of conductive pins having a length of approximately 0.50–0.75 inches. Each pin preferably has an upper end 44A, 44B, a lower end 46A, 46B and an intermediate portion 48A, 48B extending therebetween. The upper and lower ends of the electrically conductive pins may be rounded by placing a plurality of such pins in a tumbler having a media, such as aluminum oxide or silicon carbide. In other preferred embodiments, the ends of the wires may be rounded by machine tooling the ends.

Figure 3:
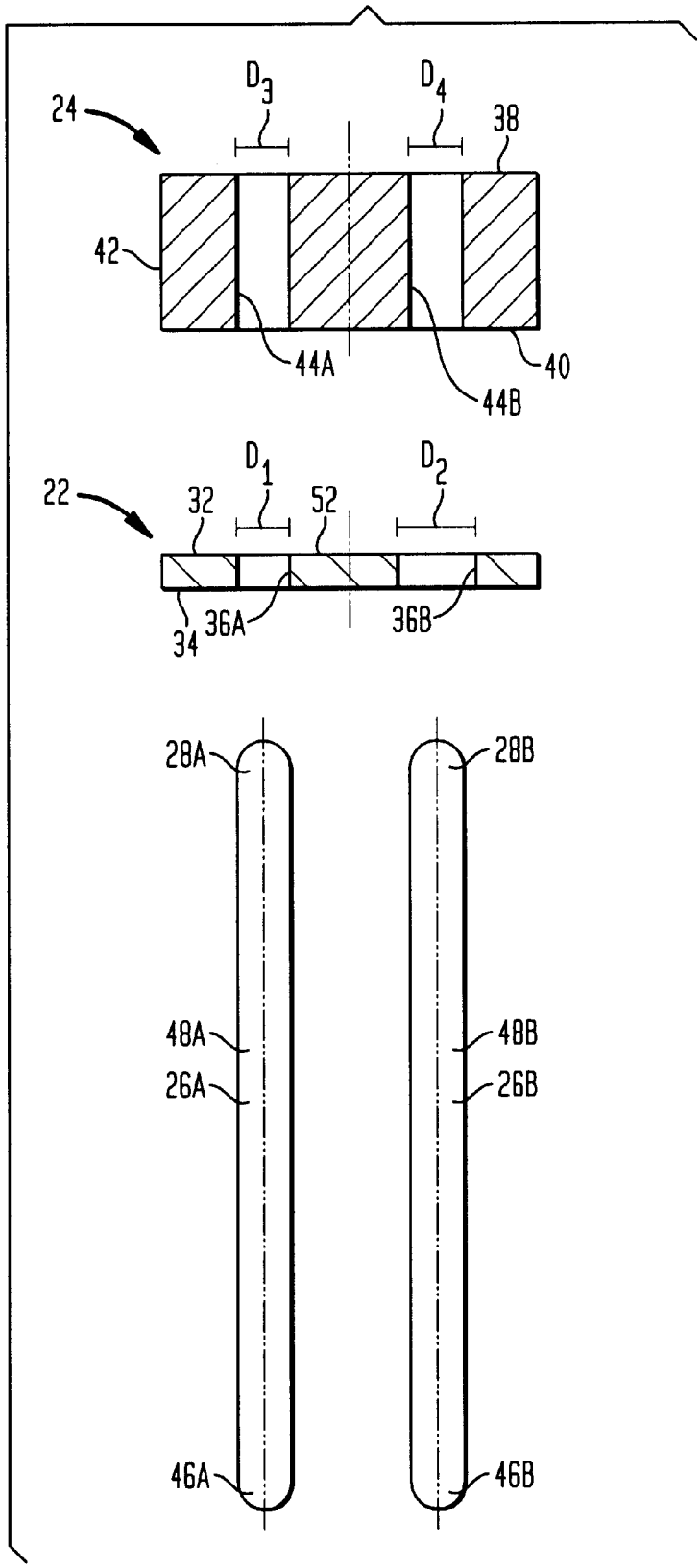
FIG. 3 shows an exploded view of the initiator header subasssembly.
Figure 4A:
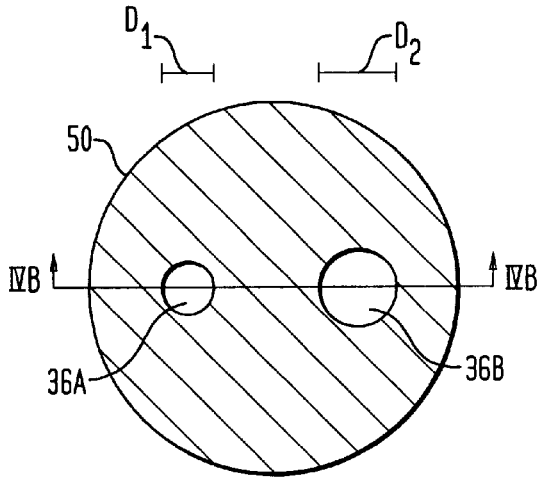
FIG. 4A shows a top view of the grounding tab shown in FIG. 2.
Figure 4B:
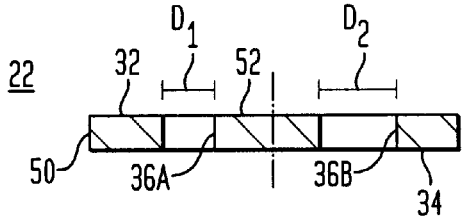
FIG. 4B shows a cross-sectional view of the grounding tab shown in FIG. 4A taken along line IVB—IVB of FIG. 4A.

FIGS. 4A and 4B show respective top and cross-sectional side views of the grounding tab 22 of FIGS. 2 and 3. As shown in FIG. 4A, grounding tab 22 includes first and second openings 36A, 36B, the second opening 36B having a larger diameter $D_2$ than the diameter $D_1$ of the first opening 36A. In certain preferred embodiments, the grounding tab is made by first providing a sheet of a conductive material such as KOVAR®. A plurality of substantially round tabs are then punched or stamped from the KOVAR® sheet. Each grounding tab preferably has a substantially coin-like appearance having an annular outer surface defining an outer peripheral surface 50 of the grounding tab. The holes 36A, 36B extending between the top and bottom surfaces 32, 34 of the grounding tab 22 are then punched through an interior region 52 of the grounding tab 22. The holes 36A, 36B are preferably sized so that electrically conductive pins (FIG. 2) may pass therethrough.

FIG. 4B shows grounding tab 50 having top surface 32 and bottom surface 34 with first and second holes 36A, 36B extending therebetween. First hole 36A has a first diameter $D_1$ and second hole 36B has a second diameter $D_2$ that is larger than the diameter of first hole 36A.

Figure 5A:
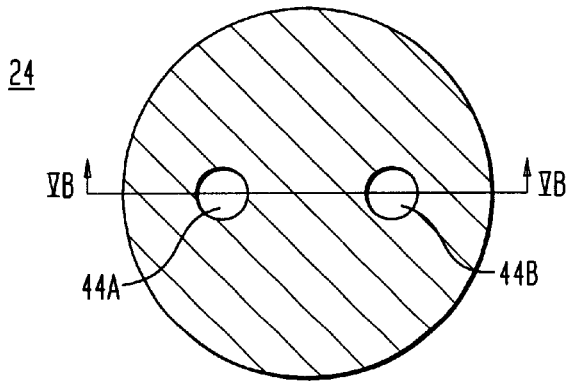
FIG. 5A shows a top view of the insulating mass shown in FIG. 2.
Figure 5B:
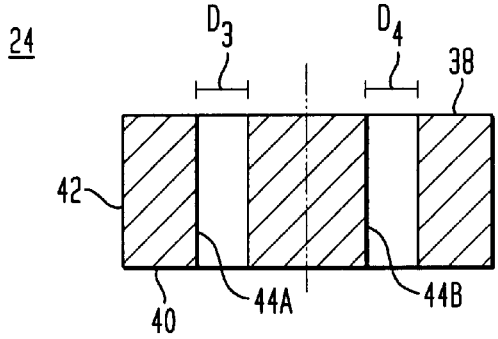
FIG. 5B shows a cross-sectional view of the insulating mass shown in FIG. 5A taken along line VB—VB of FIG. 5A.

FIG. 5A shows a top view of the insulating mass 24 of FIG. 2. The insulating mass 24 is preferably made of glass able to withstand up to 20,000 psi or more. The insulating mass 24 preferably has two longitudinal openings 44A, 44B extending between top and bottom surfaces 38, 40 thereof. The all-glass insulating disc 24 may be made by numerous methods. In certain preferred embodiments, the insulating disc is made by mixing a glass powder with a binding agent to form a plurality of glass preforms Each glass preform has the two longitudinal openings 44A, 44B extending therethrough, the pair of longitudinal openings preferably having respective diameters $D_3$, $D_4$ that are substantially equal. In certain preferred embodiments, the all-glass discs may be made of borosilicate glass or any other glass material having a relatively high hardness rating. In preferred embodiments, each glass disc is able to withstand up to 20,000 psi (pounds per square inch), while maintaining the structural integrity of the insulating disc. The insulating disc may be made from a wide variety of colors. Each distinct color may serve as an identifier for the particular use of the initiator header. For example, an initiator header having a white glass insulating disc may be used for a driver's side air bag, while an initiator header having a blue glass insulating disc may be used for a passenger side air bag. The color of the glass insulating disc may also be modified to indicate the resistance level of an initiator header.

Figure 6:
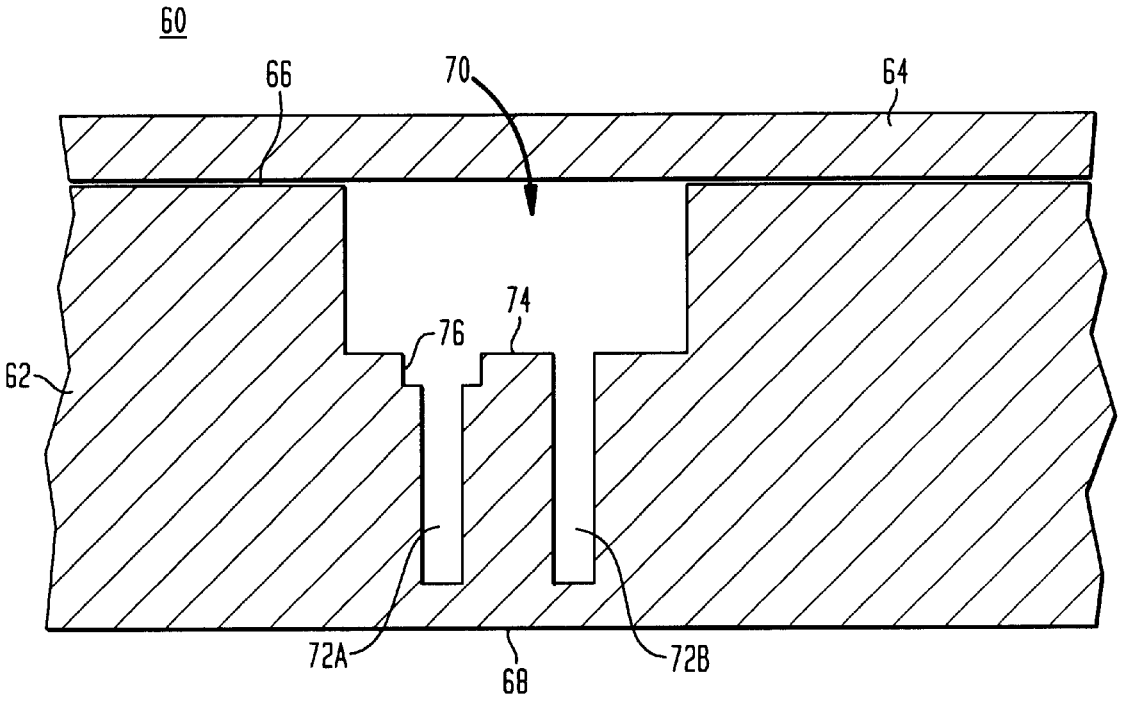
FIG. 6 shows a cross-sectional view of a fixture for assembling the initiator header subassembly of FIGS. 1 and 2, in accordance with certain preferred embodiments of the present invention.

FIG. 6 shows a fixture 60 that may be used for assembling the initiator header subassembly of FIG. 2, in accordance with certain preferred embodiments of the present invention. The fixture 60 includes a bottom member 62 and a top member 64 that sits atop the bottom member 62. The bottom member 62 includes a top surface 66, a bottom surface 68, and one or more cavities 70 formed therein. Each cavity 70 has two longitudinally extending apertures 72A, 72B for receiving the pair of electrically conductive pins. The cavity 70 also has an intermediate shelf 74 for receiving the grounding tab and the glass insulating disc. A first one of the longitudinally extending openings 72A preferably includes an enlarged diameter area 76, adjacent shelf 74, for receiving a washer or ring.

Figure 7A:
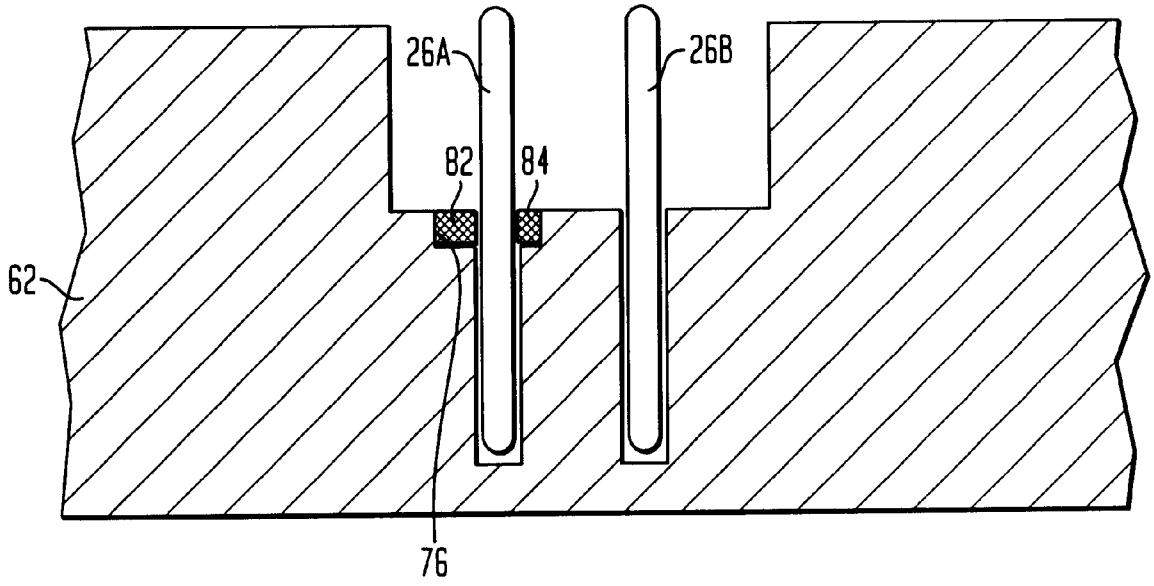
FIGS. 7A–7D show a method of making the initiator header subassembly of FIGS. 1 and 2, in accordance with certain preferred embodiments of the present invention.

Referring to FIG. 7A, in a first assembly step a pair of electrically conductive pins 26A, 26B are placed within the cavity 70 of the fixture 60. Before the pins are placed in the fixture, the pins are exposed to a chemical which removes the oxidation layer from the outer surface of the pins. After the oxidation layer has been removed from the outer surface of the pin, the pins are exposed to a chemical etchant that pits or roughens the outer surface of the pins. In certain preferred embodiments, the pins are placed a ferric chloride solution for approximately 30 seconds. During etching, the ferric chloride solution generates a roughened or pitted surface at the exterior surface of the conductive pins. The roughened surface preferably increases the surface area at the exterior surface of the conductive pins.

Figure 8A:
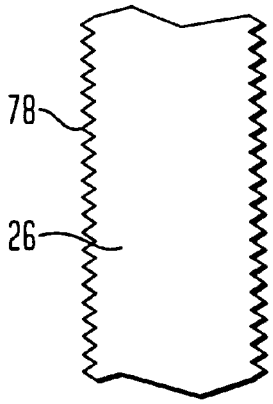
FIG. 8A shows one of the electrically conductive pins of FIG. 3 during an initial assembly step.
Figure 8B:
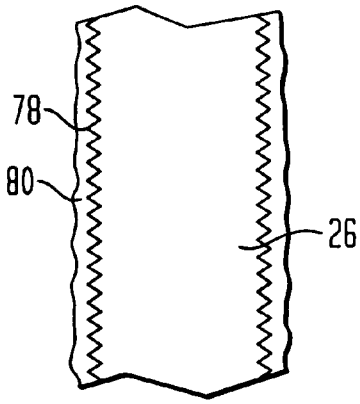
FIG. 8B shows the conductive pin of FIG. 8A during a later assembly step.

FIG. 8A shows an electrically conductive pin after the pin 26 has been exposed to a chemical etchant. The etchant removes a portion of the outer surface of the conductive pin to form a pin have a roughened surface 78. Referring to FIG. 8B, after the outer surface of the conductive pin has been etched, an oxide layer 80 may be formed over the roughened surface 78. In certain preferred embodiments, the oxide layer 80 is provided by first placing a plurality of pins in a container, such as a basket. The basket is then placed in a furnace, having an atmosphere that is approximately 97–99% nitrogen and 1–3% hydrogen. Next, the conductive pins are passed through a bubbler having an oxygen level to form an oxide layer on the outer surface of the pins. The oxide layer preferably has a thickness of approximately 1.0–3.0 $\mu$m.

Referring to FIG. 7A, before the conductive pins 26A, 26B are placed in the fixture 62, a washer or ring 82, such as a copper-silver alloy washer having a thickness of approximately 0.015 inches, may be positioned in the enlarged diameter portion 76 of the cavity. The washer 82 has a central opening 84 allowing the first conductive pin 26A to pass therethrough. As will be described in more detail below, during final assembly of the initiator header subassembly, the washer may transform from a solid to a molten state for forming an intermetallic bond between the grounding tab and at least one of the conductive pins. The fixture 62 preferably holds the pair of electrically conductive pins 26A, 26B in a substantially parallel relationship to one another.

Figure 7B:
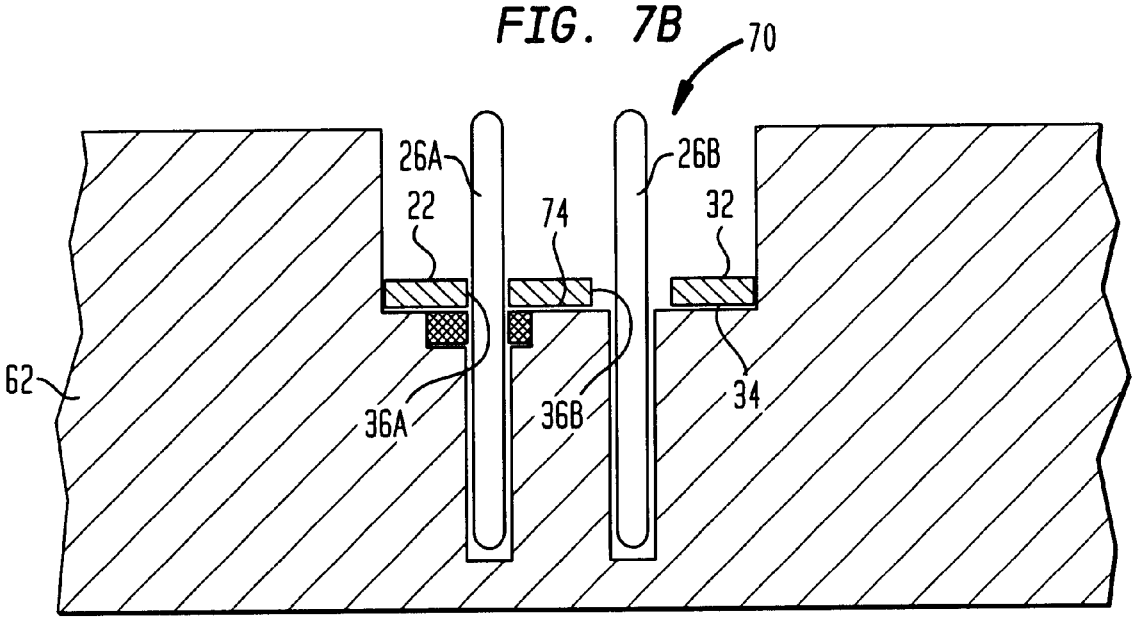

Referring to FIG. 7B, a grounding tab 22 is then placed atop shelf 74 in the cavity 70 of the fixture 62. Grounding tab 22 has top surface 32, bottom surface 34, and two holes 36A, 36B extending therethrough. The first conductive pin 26A is passed through the first hole 36A of grounding tab 22 and the second conductive pin 26B is passed though the second hole 36B of grounding tab 22.

Figure 9A:
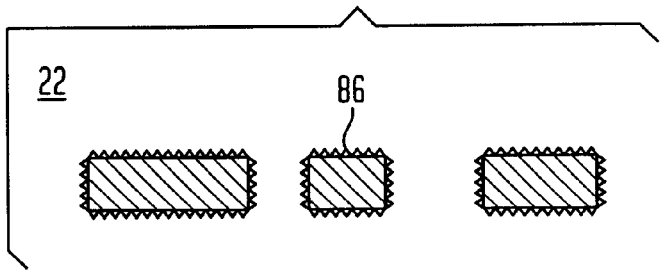
FIG. 9A shows a cross-sectional view of the grounding tab of FIG. 2 during an initial assembly step.
Figure 9B:
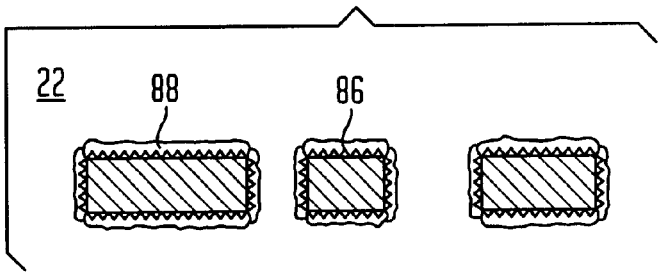
FIG. 9B shows a cross-sectional view of the grounding tab of FIG. 9A during a later assembly step.

Referring to FIGS. 9A and 9B, before grounding tab 22 is placed in cavity 70 of fixture 62, grounding tab 22 is exposed to a chemical etching solution that produces a roughened outer surface 86. Referring to FIG. 9B, after the outer surface has been roughened, grounding tab 22 is exposed to an oxidizing process which forms an oxidation layer 88 over the roughened outer surface 86 of grounding tab 22.

Figure 7C:
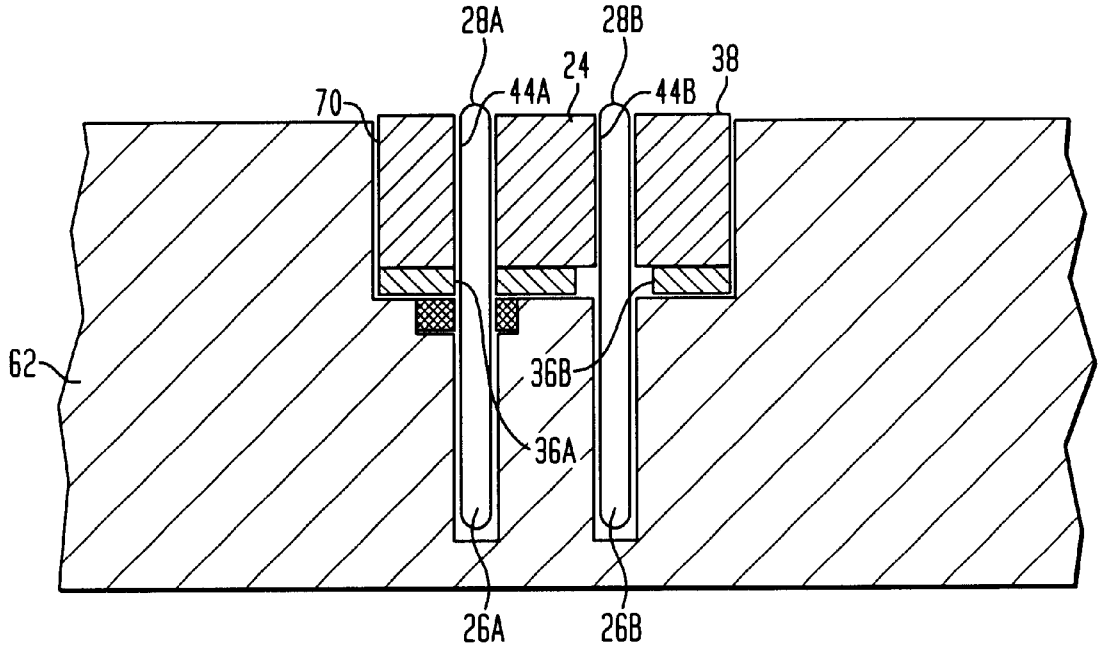

In FIG. 7C, preformed glass insulating disc 24 is then placed atop the top surface 32 of grounding tab 22 so that the openings 44A, 44B in the glass insulating disc 24 are in substantial alignment with the first and second holes 36A, 36B extending through grounding tab 22. As a result, the pair of electrically conductive pins 26A, 26B pass through the two openings 44A, 44B in the glass insulating disc 24. The respective upper ends 28A, 28B of the electrically conductive pins 26A, 26B are preferably exposed at the top surface 38 of glass insulating disc 24.

Figure 7D:
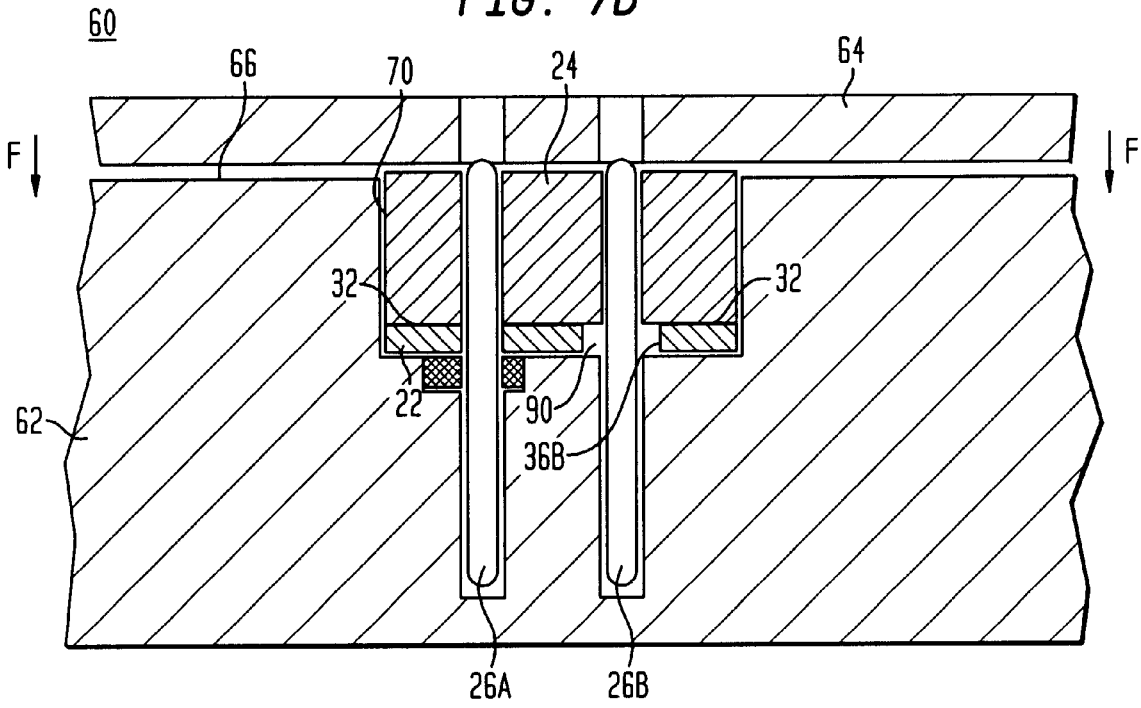

Referring to FIG. 7D, after the above-described components have been assembled within the cavity 70 of fixture 60, the upper member 64 of fixture 60 is placed atop the top surface 66 of the lower member 62 of fixture 60. A downward force F may then be applied by the top member 64 onto the bottom member 62 so as to form a seal between the upper and lower members 64, 62 of fixture 60. Next, an inert gas is preferably pumped into the sealed fixture so as to create a stable atmosphere for the oxide layers formed on the outer surface of the pair of conductive pins and the grounding tab. The fixture and the one or more initiator header subassemblies therein may then be placed in a furnace and heated to approximately 1700–1900° F. At this temperature, the glass of the insulating disc 24 becomes molten so as to form a glass-to-metal seal between the insulating glass and both the top surface 32 of grounding tab 22 and the outer surfaces of conductive pins 26A, 26B. During the heating process, a gap 90 remains between second pin 26B and the second hole 36B of grounding tab 22 so that second conductive pin 26B remains electrically isolated from grounding tab 22. In its molten state, the glass of the insulating disc 24 forms a glass-to-metal seal with the outer surface of the conductive pins 26A, 26B and the top surface 32 of grounding tab 22. The fixture 60 is then removed from the furnace and cooled.

After cooling, the initiator header subassembly may be removed from the fixture. The initiator header may be shipped directly to a customer. In other preferred embodiments, a customer may prefer that the exposed metallic surfaces of the initiator header be plated. The plated layer may include metals such as nickel, the nickel preferably providing protection against corrosion. In other preferred embodiments, the customer may prefer a metal plating of gold which is preferable when the initiator header will be bonded to one or more contacts. Gold may also be preferred for the plating layer when high conductivity is desirable, as gold is typically a better conductor than nickel.

Figure 10:
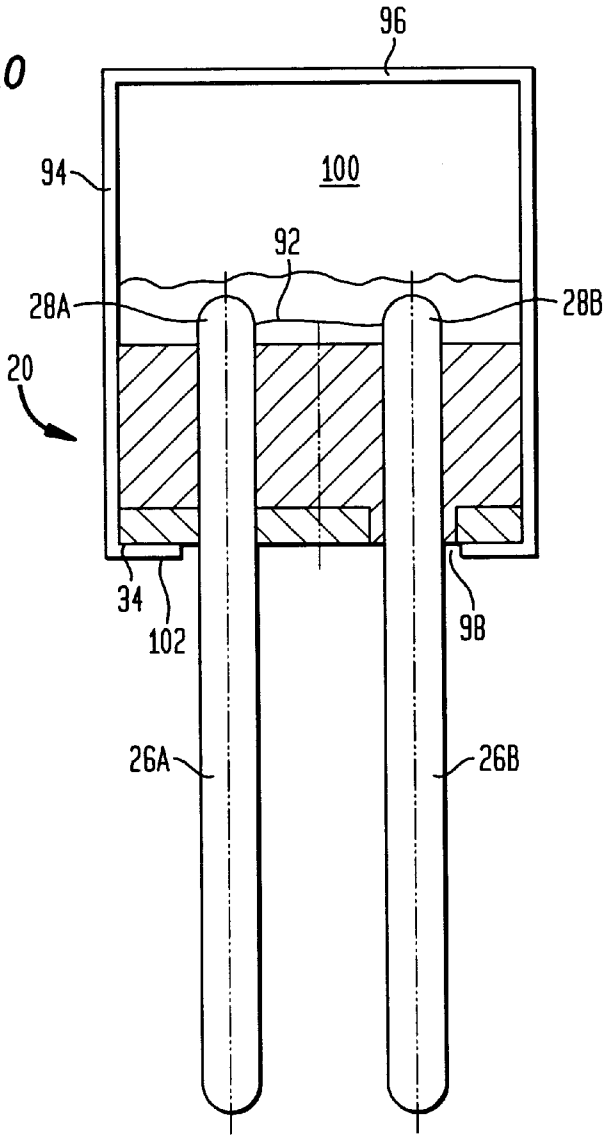
FIG. 10 shows a cross-sectional view of a subassembly and a hollow cap packed with an explosive material attached to the initiator header subassembly, in accordance with certain preferred embodiments of the present invention.

Referring to FIG. 10, after the gold or nickel has been plated on the exposed metallic surfaces of the initiator header subassembly, a bridge wire 92 may be attached adjacent the upper ends 28A, 28B of the electrically conductive pins 26A, 26B. A hollow cap 94 having a closed end 96, an open end 98, and an explosive 100 packed therein is then assembled to and permanently attached to the initiator header subassembly 20. The hollow cap 94 preferably comprises a malleable substance such as metal. The open end 98 of hollow cap 94 preferably includes flanges 102 that may be crimped over the bottom surface 34 of grounding tab 22. The flanges 102 may also be welded to grounding tab 22. In operation, an electrical charge may be passed through one of the conductive pins 26A, 26B. As the electrical charge passes through bridge wire 92, the bridge wire generates heat which ignites the explosive 100 packed within hollow cap 94. In turn, the ignited explosive 100 may ignite a combustible gas-producing material which produces a gas. The gas may be used for any of the purposes described above, i.e. inflating an air bag.

Figure 11:
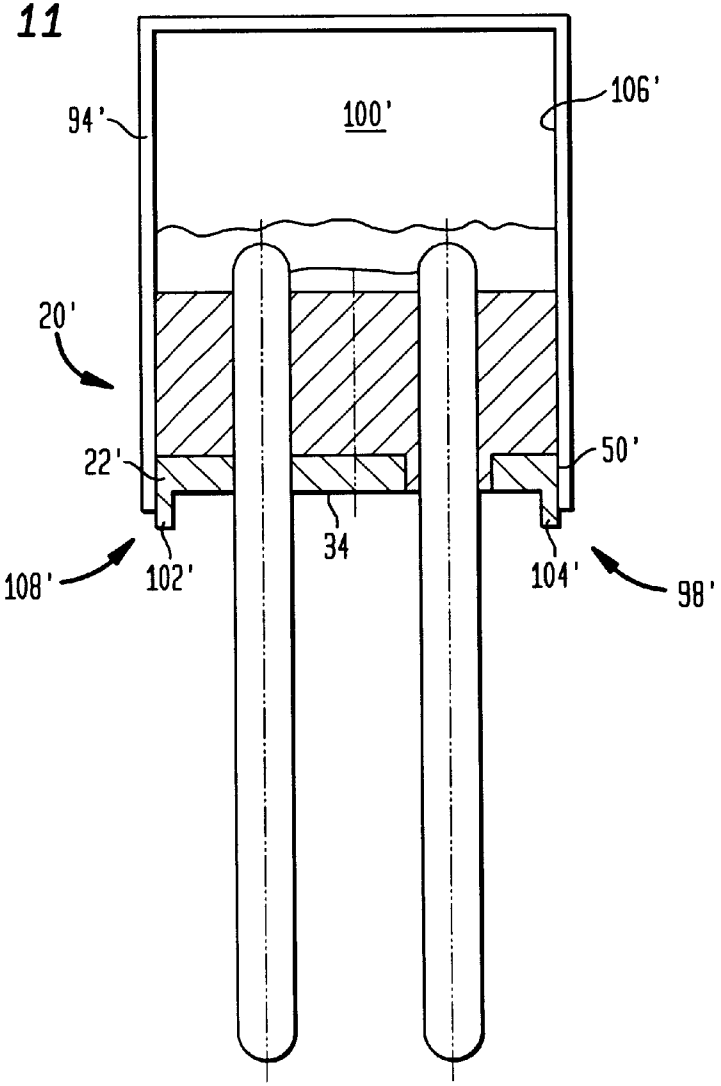
FIG. 11 shows a cross-sectional view of an initiator header subassembly and a hollow cap packed with an explosive material attached to the initiator header subassembly, in accordance with further preferred embodiments of the present invention.

FIG. 11 shows an initiator header in accordance with other preferred embodiments of the present invention. The initiator header subassembly 20' is substantially similar to that shown and described above, with the exception that the grounding tab 22' of the initiator header subassembly includes a sealing flange 102' which projects below the bottom surface 34 of grounding tab 22. The sealing flange 102' has an outer perimeter 104' that substantially matches the outer perimeter 50' of grounding tab 22'. After assembly, a hollow cap 94' having an explosive 100' packed therein may be attached to the initiator header subassembly 20' by sliding an open end 98' of cap 94' over the initiator header subassembly 20'. The inner walls 106' of cap 94' at the open end 98' thereof may closely engage the flange portion 104' of grounding tab 22'. The assembly may then be crimped in the region of the flange/cap interface 108' to permanently attach the hollow cap 94' to the initiator header subassembly 20'. In other embodiments, a welding process may be used to permanently weld the open end 98' of the cap 94' to the flange 104' projecting from the grounding tab 22.

Figure 12:
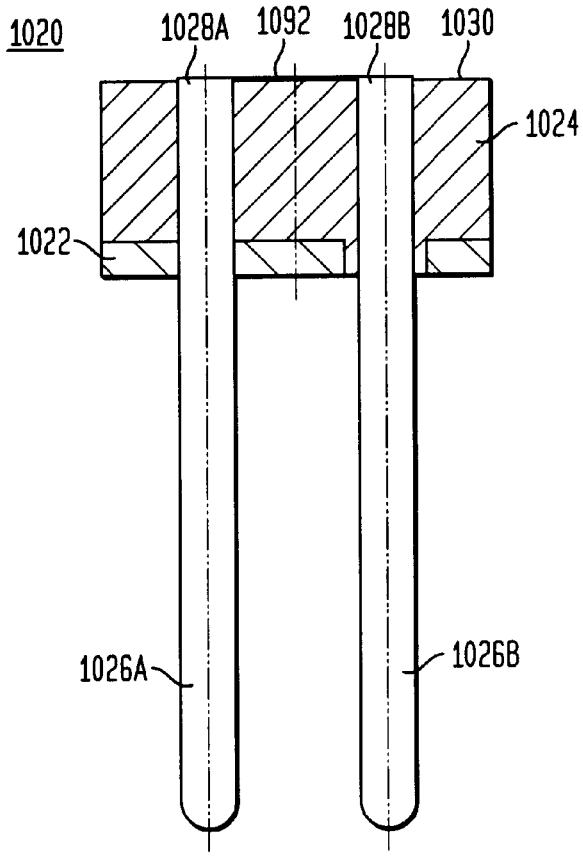
FIG. 12 shows a cross-section view of an initiator header subassembly, in accordance with further preferred embodiments of the present invention.
Figure 13:
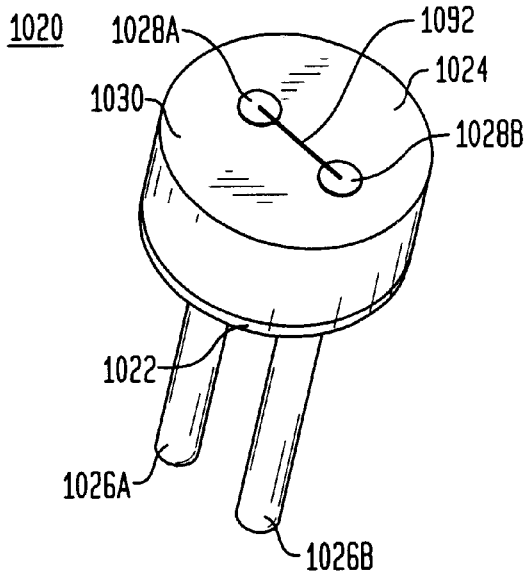
FIG. 13 shows a perspective view of the initiator header subassembly of FIG. 12.

FIGS. 12 and 13 show an initiator header subassembly 1020, in accordance with further preferred embodiments of the present invention. The initiator header subassembly 1020 includes a grounding tab 1022, a mass of an insulating material 1024 and a pair of electrically conductive pins 1026A and 1026B extending completely through grounding tab 1022 and insulating mass 1024. The upper ends 1028A and 1028B of the respective electrically conductive pins 1026A and 1026B are preferably flush with the top surface 1030 of insulating mass 1024. In the particular embodiment shown in FIGS. 12 and 13, the upper ends 1028A, 1028B' of conductive pins 1026A, 1026B do not project above the top surface 1030 of insulating mass 1024, as is provided in the embodiment shown in FIGS. 1 and 2. The top ends of the pins may be made flush by cutting off portions of the pins that project above the top surface 1030 of insulating mass 1024. The upper ends of conductive pins 1026A, 1026B may also be made flush with top surface 1030 of insulating mass 1024 by sanding the conductive pins or by assembling the initiator header subassembly so that the conductive pins do not project beyond the top surface 1030 of insulating mass 1024.

Referring to FIG. 13, a bridge wire 1092 may be secured over top surface 1030 of insulating mass 1024 for electrically interconnecting conductive pins 1026A, 1026B. Bridge wire 1092 is preferably permanently attached to upper ends 1028A, 1028B of conductive pins 1026A, 1026B, such as by welding bridge wire 1092 to the conductive pins.

Figure 14:
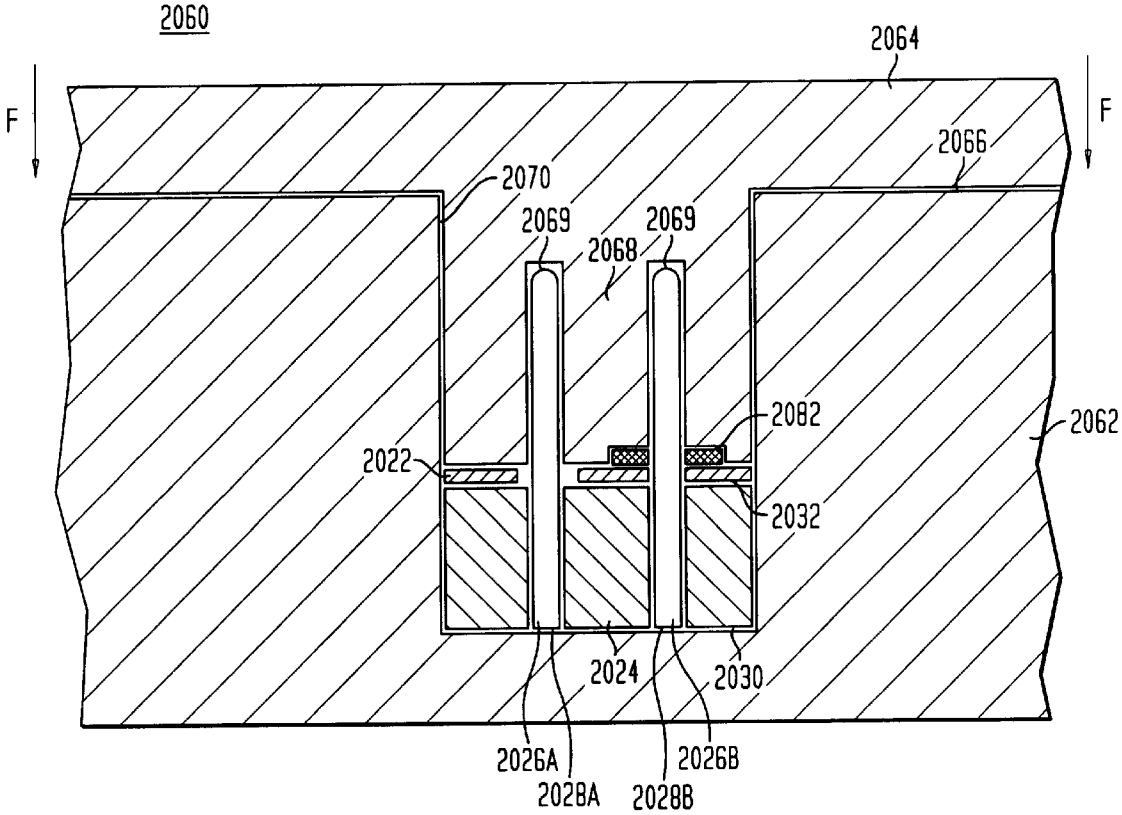
FIG. 14 shows a cross-sectional view of a fixture for assembling the initiator header subassembly of FIGS. 12 and 13, in accordance with further preferred embodiments of the present invention.

FIG. 14 shows a fixture 2060 used to assemble the initiator header subassembly 1020 shown in FIGS. 12 and 13. Fixture 2060 includes a cavity 2070 having an outer diameter sized to receive the components of an initiator header subassembly. In a first assembly step, a mass of an insulating material 2024 is inserted into cavity 2070 and a pair of conductive pins 2026A and 2026B are inserted into openings extending through the insulating mass 2024. In the particular embodiment shown in FIG. 14, the ends 2028A, 2028B of the pair of conductive pins have been flattened so that the upper ends of the conductive pins are substantially flush or parallel with top surface 2030 of insulating mass 2024. Before the conductive pins 2026A, 2026B are placed in the openings of the insulating mass 2024, the exterior surfaces of the pins are preferably roughened and an oxide layer formed over the roughened surfaces, as described above. Next, grounding tab 2022 is placed atop insulating mass 2024 with conductive pins 2026A, 2026B passing through the first and second holes 2036A, 2036B of grounding tab 2022. A washer 2082, such a copper-silver alloy washer may then be passed over conductive pin 2026B and positioned atop grounding tab 2022.

After the above-described components have been assembled within cavity 2070 of fixture 2060, upper member 2064 of fixture 2060 is placed atop the top surface 2066 of lower member 2062 of fixture 2060. Upper member 2064 includes a specially designed projection 2068 having cavities 2069 that match the contour of the initiator header components previously assembled within cavity 2070 of lower member 2062. A downward force F may then be applied by top member 2064 onto bottom member 2062 so as to form an air tight seal between upper and lower members 2064, 2062 of fixture 2060. As downward force F is applied, projection 2068 compresses the components of the initiator header subassembly together. An inert gas may then be pumped into the seal fixture so as to create a stable atmosphere for the oxide layer formed on the outer surfaces of the conductive pins and the grounding tab 2022. Fixture 2060 and one or more initiator header subassemblies therein may then be placed in a furnace and heated to transform insulating mass 2024 into a molten material so as to form a glass-to-metal seal between insulating disc 2024 and grounding tab 2022 and conductive pins 2026A, 2026B. In its molten state, the glass of insulating disc 2024 forms a glass-to-metal seal with the outer surfaces of conductive pins 2026A, 2026B and top surface 2032 of grounding tab 2022. Fixture 2060 may then be removed from the furnace so as to cool the initiator header subassemblies.

Although the fixture shown in FIG. 14 is used to assemble initiator header subassemblies having upper ends of conductive pins flush with a top surface of an insulating mass, in other preferred embodiments the design of cavity 2070 of lower fixture member 2062 may be altered so that the upper ends of the conductive pins extend above the top surface of an insulating mass.

Figure 15:
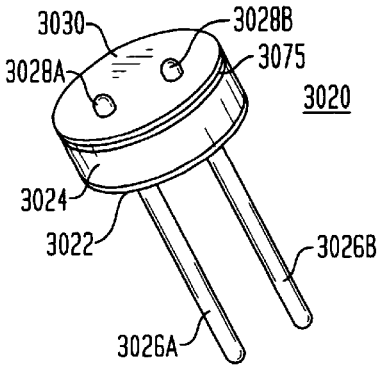
FIG. 15 shows a perspective view of an initiator header subassembly, in accordance with further preferred embodiments of the present invention.
Figure 16:
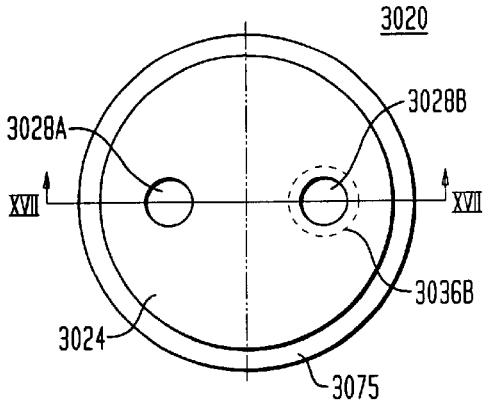
FIG. 16 shows a plan view of the initiator header subassembly of FIG. 15.

In FIGS. 15 and 16, an initiator header subassembly 3020, in accordance with still preferred embodiments of the present invention, includes a grounding tab 3022, a mass of an insulating material 3024 and a pair of electrically conductive pins 3026A and 3026B extending completely through grounding tab 3022 and insulating mass 3024. The respective upper ends 3028A and 3028B of electrically conductive pins 3026A and 3026B are preferably projecting above the top surface 3030 of insulating mass 3024. Adjacent the top surface 3030 of insulating mass 3024, an annular groove (not shown) is formed at the intersection of top surface 3030 and peripheral sidewall 3042. A ring 3075 of a material that is preferably harder than the insulating mass 3024 is secured within the groove. In certain preferred embodiments, the ring 3075 is a conductive material such as metal. The ring 3075 may comprise the same material as the conductive pins 3026A, 3026B and/or the grounding tab 3022. Although the present invention is not limited any particular theory of operation, it is believe that ring 3075 provides a sharp corner for mounting a hollow cap having a charge disposed therein (e.g. hollow cap 96 and charge 100 shown in FIG. 10. The ring 3075 may provide an improvement over other assemblies wherein the hollow cap is secured directly over the upper edge of an insulating mass. The sharp corners of the ring 3075 facilitate mounting and seating of the hollow cap atop the insulating mass.

Figure 17:
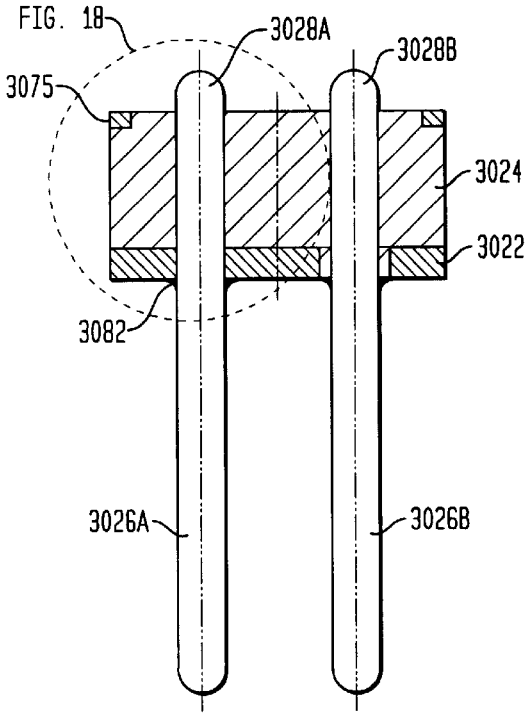
FIG. 17 shows a cross-section view of the initiator header subassembly of FIGS. 15 and 16 taken along the line XVII—XVII of FIG. 16.
Figure 18:
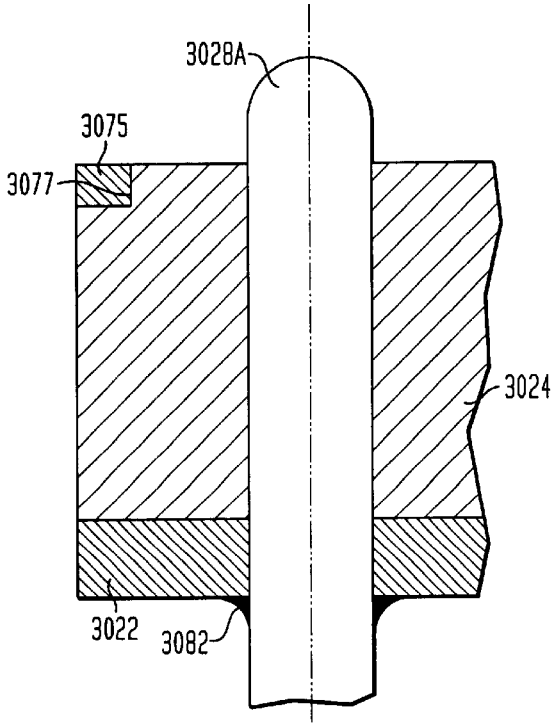
FIG. 18 shows an enlarged fragmentary view of a portion of the initiator header subassembly shown in FIG. 17.

Referring to FIGS. 17 and 18, conductive ring 3075 is secured in groove 3077 and extends about the outer perimeter of insulating mass 3024. First conductive pin 3026A is bonded to grounding tab 3022 by braising material 3082. FIG. 18 shows an enlarged view of a portion of FIG. 17 including annular groove 3077 formed at the intersection of top surface 3030 and sidewall 3042. As mentioned above, annular groove 3077 extends completely around the outer perimeter of top surface 3030 of insulating mass 3024.

Figure 19:
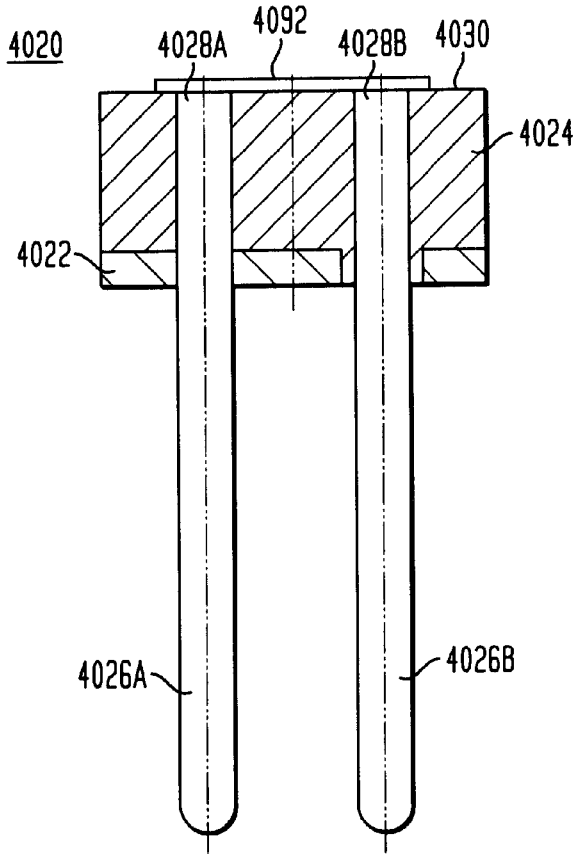
FIG. 19 shows a cross-sectional view of an initiator head subassembly including a semiconductor bridge, in accordance with still further preferred embodiments of the present invention.
Figure 20:
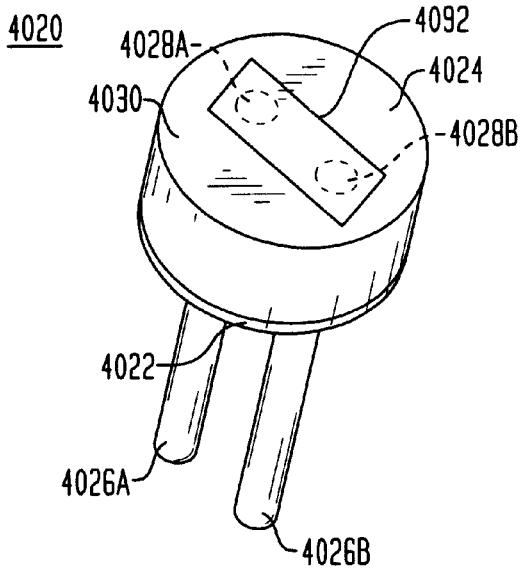
FIG. 20 shows a perspective view of the initiator header subassembly of FIG. 19.

FIGS. 19 and 20 show an initiator header subassembly 4020, in accordance with further preferred embodiments of the present invention. The initiator header subassembly 4020 includes a grounding tab 4022, a mass of an insulating material 4024 and a pair of electrically conductive pins 4026A and 4026B extending completely through grounding tab 4022 and insulating mass 4024. The upper ends 4028A and 4028B of the respective electrically conductive pins 4026A and 4026B are preferably flush with the top surface 4030 of insulating mass 4024. In the particular embodiments shown in FIGS. 19 and 20, the upper ends 4028A, 4028B of conductive pins 4926A, 4026B do not project above the top surface 4030 of insulating mass 4024, as is provided in the embodiments shown in FIGS. 1 and 2. The top ends of the pins may be made flush by cutting off portions of the pins that project above the top surface 4030 of insulating mass 4024. The upper ends of the pins 4026A, 4026B may also be made flush with top surface 4030 of insulating mass 4024 by sanding the conductive pins or by assembling the initiator header subassembly so that the conductive pins do not project beyond the top surface 4030 of insulating mass 4024.

Referring to FIG. 20, a semiconductor bridge 4092 may be secured over top surface 4030 of insulating mass 4024 for electrically interconnecting conductive pins 4026A, 4026B.

As these and other variations and combinations of the features discussed above can be employed, the foregoing description of preferred embodiments should be taken by way of illustration rather than as limiting the invention.

What is claimed is:

1. An initiator header subassembly comprising:

an electrically conductive grounding tab having an outer perimeter;

a mass of an insulating material secured atop said grounding tab, said mass of an insulating material having a top surface, a bottom surface and a sidewall extending between the top and bottom surfaces;

two electrically conductive pins extending completely through said grounding tab and said mass of an insulating material, a first one of said electrically conductive pins being electrically interconnected with said grounding tab and a second one of said electrically conductive pins being electrically isolated from said grounding tab, wherein the sidewall of said mass of an insulating material is in substantial alignment with the outer perimeter of said grounding tab.

2. The initiator header subassembly as claimed in claim 1, wherein the sidewall of said mass of an insulating material defines the outer perimeter of said subassembly.

3. The initiator header subassembly as claimed in claim 1, wherein said subassembly includes one or more glass to metal seals for permanently securing together said grounding tab, said insulating mass and said two electrically conductive pins.

4. The initiator header subassembly as claimed in claim 1, wherein said grounding tab is made of a conductive metal.

5. The initiator header subassembly as claimed in claim 4, wherein said grounding tab is made of an alloyed metal.

6. The initiator header subassembly as claimed in claim 4, wherein said grounding tab has a coefficient of thermal expansion that substantially matches the coefficient of thermal expansion of said mass of an insulating material.

7. The initiator header subassembly as claimed in claim 1, wherein said grounding tab is substantially flat and has a top surface, a bottom surface, and two holes extending between the top and bottom surfaces thereof, the two holes of said grounding tab being adapted to receive said two electrically conductive pins.

8. The initiator header subassembly as claimed in claim 7, wherein the top and bottom surface of said grounding tab is roughened.

9. The initiator header subassembly as claimed in claim 7, wherein a first one of the two grounding tab holes has a first diameter, and a second one of the two grounding tab holes has a second diameter that is greater than the diameter of the first grounding tab hole.

10. The initiator header subassembly as claimed in claim 9, wherein the electrically interconnected pin passes through the first grounding tab hole and the electrically isolated pin passes through the second grounding tab hole.

11. The initiator header subassembly as claimed in claim 7, wherein said mass of an insulating material is an insulating disc having two longitudinal openings extending from the top surface to the bottom surface of said insulating disc, said two longitudinal openings having a substantially similar diameter.

12. The initiator header subassembly as claimed in claim 11, wherein said two longitudinal openings of said insulating disc are in substantial alignment with the two holes extending through said grounding tab.

13. The initiator header subassembly as claimed in claim 12, wherein each said electrically conductive pin passes through one of the longitudinal openings of said insulating disc and one of the grounding tab holes.

14. The initiator header subassembly as claimed in claim 13, wherein the outer surface of said conductive pins is roughened.

15. The initiator header subassembly as claimed in claim 13, wherein the outer diameter of said pins substantially matches the inner diameter of the two longitudinal openings of said insulating disc.

16. The initiator header subassembly as claimed in claim 1, wherein said insulating disc is an all-glass-insulating disc.

17. The initiator header subassembly as claimed in claim 16, wherein said all-glass insulating disc comprises borosilicate glass.

18. The initiator header subassembly as claimed in claim 1, wherein said grounding tab, said insulating disc and said electrically conductive pins have a substantially similar coefficient of thermal expansion.

19. The initiator header subassembly as claimed in claim 1, wherein said two electrically conductive pins are substantially parallel with one another.

20. The initiator header subassembly as claimed in claim 1, wherein the upper ends of said two electrically conductive pins are accessible at the top surface of said mass of an insulating material.

21. The initiator header subassembly as claimed in claim 20, wherein the upper ends of said conductive pins project above the top surface of said insulating mass.

22. The initiator header subassembly as claimed in claim 1, further comprising a bridge wire electrically interconnecting the upper ends of said two electrically conductive pins.

23. The initiator header subassembly as claimed in claim 1, further comprising a semiconductor bridge disposed atop the first surface of said mass of an insulating material, said semiconductor bridge electrically interconnecting the upper ends of said two electrically conductive pins.

24. An initiator header subassembly comprising:

an electrically conductive grounding tab having an outer perimeter;

a mass of an insulating material secured atop said grounding tab, said mass of an insulating material having a top surface, a bottom surface and a sidewall extending between the top and bottom surfaces, wherein the sidewall of said mass of an insulating material and the outer perimeter of said grounding tab are in substantial alignment with one another;

two electrically conductive pins extending completely through said grounding tab and said insulating material, a first one of said electrically conductive pins being electrically interconnected with said grounding tab and a second one of said electrically conductive pins being electrically isolated from said grounding tab, wherein the sidewall of said mass of insulating material defines an outer perimeter of said subassembly.

25. An initiator header subassembly comprising:

an electrically conductive grounding tab having a top surface, a bottom surface, and two holes extending between the top and bottom surfaces, said grounding tab having an outer perimeter;

an insulating disc secured atop the first surface of said grounding tab, said insulating disc having a top surface, a bottom surface and two longitudinal openings extending between the top and bottom surfaces, said two longitudinal openings being in substantial alignment with the two holes extending through said grounding tab, said insulating disc having an outer peripheral surface extending between the top and bottom surfaces of said insulating disc;

two electrically conductive pins extending through the holes in said grounding tab and the longitudinal openings in said insulating disc, a first electrically conductive pin being electrically interconnected with said grounding tab and a second electrically conductive pin being electrically isolated from said grounding tab, wherein the peripheral surface of said insulating disc is in substantial alignment with the outer perimeter of said grounding tab.

26. The initiator header subassembly as claimed in claim 25, wherein the peripheral surface of said insulating disc defines the outer perimeter of said assembly.

27. The initiator header subassembly as claimed in claim 25, wherein said grounding tab, said insulating disc and said electrically conductive pins have a substantially similar coefficient of thermal expansion.

28. The initiator header subassembly as claimed in claim 25, wherein said grounding tab, said insulating disc and said electrically conductive pins are secured together using one or more glass to metal seals.

29. An initiator header subassembly comprising:

a conductive grounding tab having an outer perimeter;

an insulating disc secured atop the conductive grounding tab, said insulating disc having an outer peripheral surface that is in substantial alignment with the outer perimeter of said grounding tab;

a pair of electrically conductive pins extending completely through said conductive grounding tab and said insulating disc, a first one of said pins being electrically interconnected with said grounding tab and a second one of said pins being electrically isolated from said grounding tab.

30. The initiator header subassembly as claimed in claim 29, wherein said pair of electrically conductive pins are substantially parallel with one another.

31. The initiator header subassembly as claimed in claim 29, wherein said grounding tab and said conductive pins are made of an alloyed metal.

32. The initiator header subassembly as claimed in claim 29, wherein said insulating disc is made of glass.

33. The initiator header subassembly as claimed in claim 32, wherein said insulating disc is made of borosilicate glass.

* * * * *